US005676096A

United States Patent [19]

Nishi et al.

[11] Patent Number: 5,676,096

[45] Date of Patent: Oct. 14, 1997

[54] ENGINE CYLINDER LINER

[75] Inventors: Kengo Nishi; Takamasa Nishina, both of Iwata, Japan

[73] Assignee: Yamaha Hatsudoki Kabushiki Kaisha, Iwata, Japan

[21] Appl. No.: 706,817

[22] Filed: Sep. 3, 1996

[30] Foreign Application Priority Data

Aug. 31, 1995 [JP] Japan ..... 7-248588

[51] Int. Cl.[6] ..... F02F 1/10

[52] U.S. Cl. ..... 123/41.83; 123/193.3

[58] Field of Search ..... 123/41.72, 41.74, 123/41.83, 41.84, 193.3

*Primary Examiner*—Noah P. Kamen

*Attorney, Agent, or Firm*—Knobbe, Martens, Olson, Bear LLP

[57] ABSTRACT

A lightweight high-performance internal combustion engine embodying screwed-in cylinder liners that are screwed into the cylinder head for forming the combustion chambers. The cylinder liners are formed from a lightweight alloy having a hardened cylinder bore surface. A sealing arrangement is provided between the cylinder block and the cylinder liners for confining the cooling jacket relative to the threaded connection between the cylinder head and the cylinder liner for precluding liquid coolant from reaching the threaded connection.

15 Claims, 4 Drawing Sheets

ENGINE CYLINDER LINER

BACKGROUND OF THE INVENTION

This invention relates to an internal combustion engine and more particularly to an improved cylinder liner arrangement therefor.

As is well know, the combustion chamber in an internal combustion engine is formed by a cylinder block, a cylinder head which closes one end of one or more cylinder bores formed in the cylinder block, and pistons that reciprocate in the cylinder bores. Obviously, the joint between the cylinder block and the cylinder head around the cylinder bores is quite critical. This joint should not only be capable of sealing compression pressures, as well as the pressures of the expanding burning charge, but also normally provide a water seal between a water jacket formed in the cylinder block and the cylinder head, and the actual combustion chamber.

The problem of providing these seals has been one which has vexed engineers for years. In order to improve the sealing characteristics, particularly in times when modern sealing materials were not available, it was frequently the practice to form an engine block that had an integral cylinder head and cylinder block. In addition to presenting a number of difficulties in actually manufacturing the engine, the servicing of such engines is quite complicated. This is particularly true when overhead valves and overhead camshafts are employed.

With modern cylinder head gasketing material, there has been a tendency in conjunction with both high-performance and production engines to employ separate cylinder heads and cylinder blocks. The formation of the cylinder bore and the associated cooling jacket, as well as the compression sealing, nevertheless presents a major problem.

In order to reduce the weight of the cylinder block, utilization of light alloy materials, such as aluminum, aluminum alloys or the like, have been employed. However, the pistons are also frequently formed from aluminum and aluminum alloys, and it is desirable to provide dissimilar sliding surface materials between the piston and the cylinder bore.

If the cylinder block is formed as a casting, and the cylinder bore is also cast integrally with the block, then it becomes difficult to guarantee and ensure the desired cooling passages and cooling arrangement. In addition, this frequently requires the use of separate liners and/or lining materials that are formed in the cylinder block and which actually form the surface of the cylinder bores. A number of methods and constructions have been proposed for this purpose, but they also have, in some instances, undesirable attributes.

Another type of construction has been proposed to partially solve these problems. In this type of construction, the cylinder head is detachable from the cylinder block, but the cylinder liner is affixed to the cylinder head rather than to the cylinder block. Normally, this type of construction employs an arrangement wherein the cylinder liner has a threaded connection to the cylinder head. By providing such a connection, there is greater flexibility in forming the cylinder block cooling jacket, and the compression seal can be more easily accomplished. In fact, the structure is similar in sealing regards to an integral cylinder block/cylinder head arrangement.

In addition, the use of dissimilar materials can be compensated for along with their different thermal expansions by permitting the lower end of the cylinder liner to slide relative to the cylinder block. An O-ring type seal can accommodate such movement and provide good results. However, the previous type screwed-in liners utilized with cylinder heads and the cylinder head construction have still offered some problems.

That is, if the water jacket around the cylinder block and cylinder liner is configured so that the coolant can contact the threaded connection between the cylinder liner and the cylinder head, corrosion problems can occur. This is particularly true where dissimilar materials are utilized. With such an arrangement, electro-galvanic corrosion can occur. This makes it very difficult to remove the cylinder liners for servicing. This is particularly true if the liners are provided with a thin wall construction.

It is, therefore, a principal object of this invention to provide an improved cylinder liner/cylinder head connection assembly for an engine wherein the threaded connection between the cylinder head and the cylinder liner can be easily sealed from liquid coolant without reducing the cooling capability of the engine.

It is a further object of this invention to provide an improved sealing arrangement for a cylinder head/cylinder liner arrangement.

The problems aforenoted also can be particularly troublesome with multiple cylinder engines. Although the arrangement of screwing the liner into the cylinder head simplifies or obviates the necessity for a compression sealing cylinder head gasket, there is still the problem of isolating and confining the coolant to the desired areas.

It is, therefore, a still further object of this invention to provide an improved cylinder liner/cylinder head arrangement for a multi-cylinder engine and an improved sealing gasket therefor.

For the most part, engines having cylinder heads with screwed-in liners have employed aluminum or other light alloy castings for the basic cylinder head. The liner has, for the most part, been formed from a cast iron or similar material. This gives rise to not only the electro-galvanic corrosion problems aforenoted, but also further aggravates the problem of different thermal expansions. Furthermore, this construction does not provide as light a weight as might be desirable.

It is, therefore, a still further object of this invention to provide an improved lightweight screwed-in cylinder liner for the cylinder head of an internal combustion engine.

SUMMARY OF THE INVENTION

A first feature of this invention is adapted to be embodied in an internal combustion engine having a cylinder block, a cylinder head detachably affixed to said cylinder block, and a cylinder liner having a screw-threaded connection to the cylinder head for forming a cylinder bore. The cylinder bore is adapted to receive a piston for connection to a crankshaft that is journaled for rotation relative to the cylinder block. A cooling jacket is formed, at least in part, around the cylinder liner by the cylinder liner and the cylinder block. A seal is interposed between the cylinder liner and the cylinder block for precluding coolant from passing from the cooling jacket to the area of the threaded connection between the cylinder head and the cylinder liner.

Another feature of the invention is also adapted to be embodied in an internal combustion engine that has a cylinder head with a threadedly connected cylinder liner. The cylinder head and cylinder liner are both formed from respective light alloy metallic materials. The cylinder liner is formed with a surface coating for providing a hardened sliding surface for a piston that is received within the cylinder bore.

DETAILED DESCRIPTION OF THE PREFERRED EMBODIMENTS OF THE INVENTION

Figure 1:
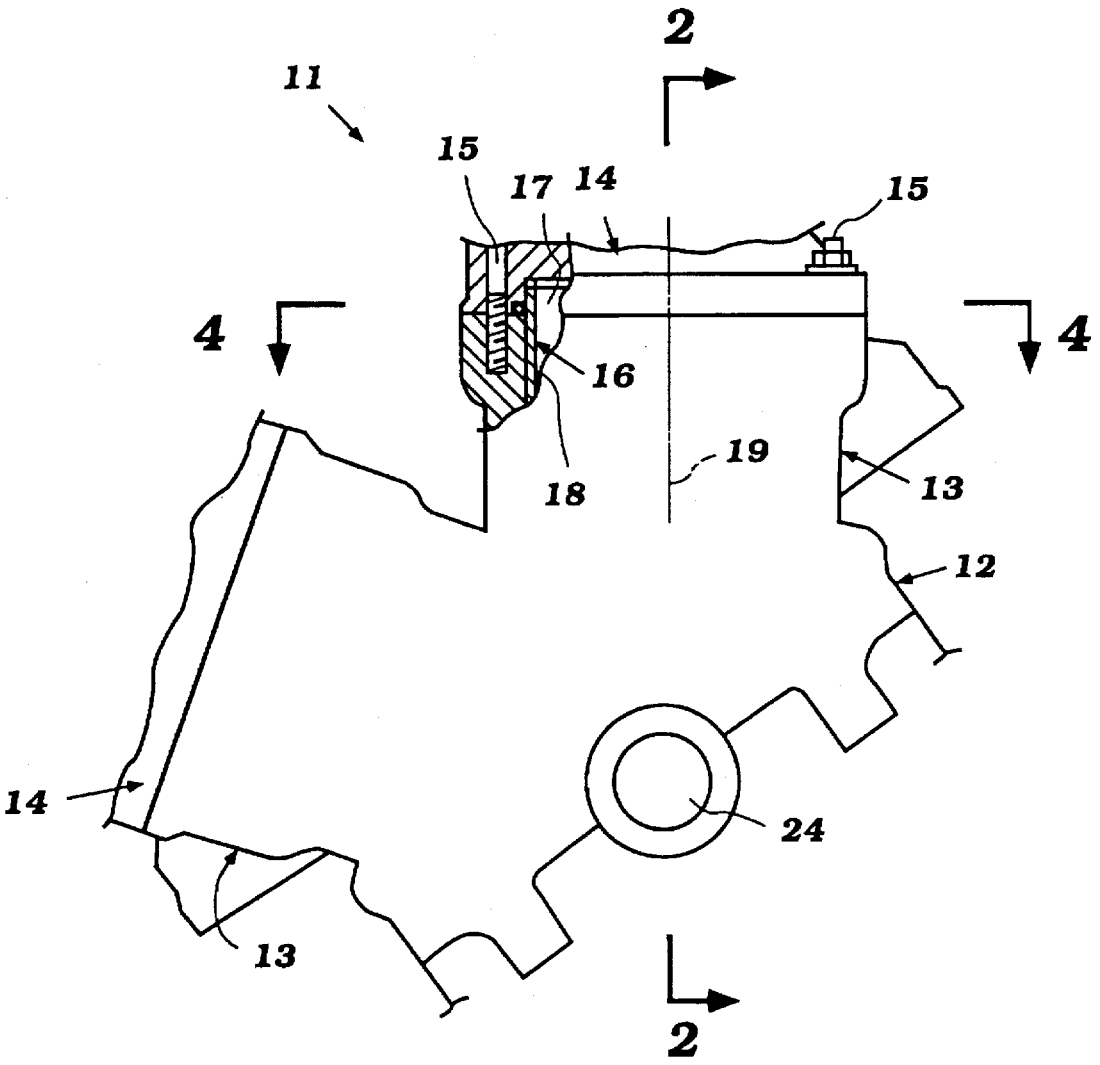
FIG. 1 is an end elevational view of a portion of an internal combustion engine constructed in accordance with an embodiment of the invention, with a portion broken away and shown in section.

Referring now in detail to the drawings, and initially to FIG. 1, a high-performance internal combustion engine constructed in accordance with an embodiment of the invention is identified generally by the reference numeral 11, and is shown partially. Since the invention deals primarily with the manner in which the combustion chambers of the engine are formed and sealed, other details of the engine 11 within this construction are not illustrated nor are all of the portions of the engine 11 illustrated or described. Thus, where any portion of the engine 11 is not illustrated or described, it may be considered to be conventional.

In the illustrated embodiment, the engine 11 is depicted as being of a V6 type, and thus is formed with a cylinder block, indicated generally by the reference numeral 12, which is formed with a pair of angularly inclined cylinder banks 13. Although the invention is described in conjunction with an engine of this configuration, it will be apparent to those skilled in the art how the invention can be utilized with engines having other configurations and engines having other numbers of cylinders. However, the invention does have particular utility in conjunction with multi-cylinder engines, for a reason which will be described.

The cylinder block 12 is, in a preferred embodiment of the invention, formed from a lightweight metal, such as an aluminum or aluminum alloy casting. As will become apparent, the construction of the arrangement which forms the combustion chambers permits the use of a cast cylinder block in which the cylinder cooling jackets can be conveniently formed, and their size and shape accurately controlled.

A cylinder head assembly, indicated generally by the reference numeral 14, is affixed to each of the cylinder banks 13 by means that include threaded fasteners 15. Each cylinder head 14 includes a plurality of cylinder liners, one for each cylinder bore, which cylinder liners are indicated generally by the reference numeral 16. These cylinder liners 16 are also formed primarily from a light alloy material, as will also be described. The cylinder liners 16 are formed with internal surfaces 17 that form cylinder bores 18. The axes of the cylinder bores 18 of each cylinder banks 13 lie on a common plane 19, one of which is shown in FIG. 1, and which also forms the section line for FIG. 2.

Figure 2:
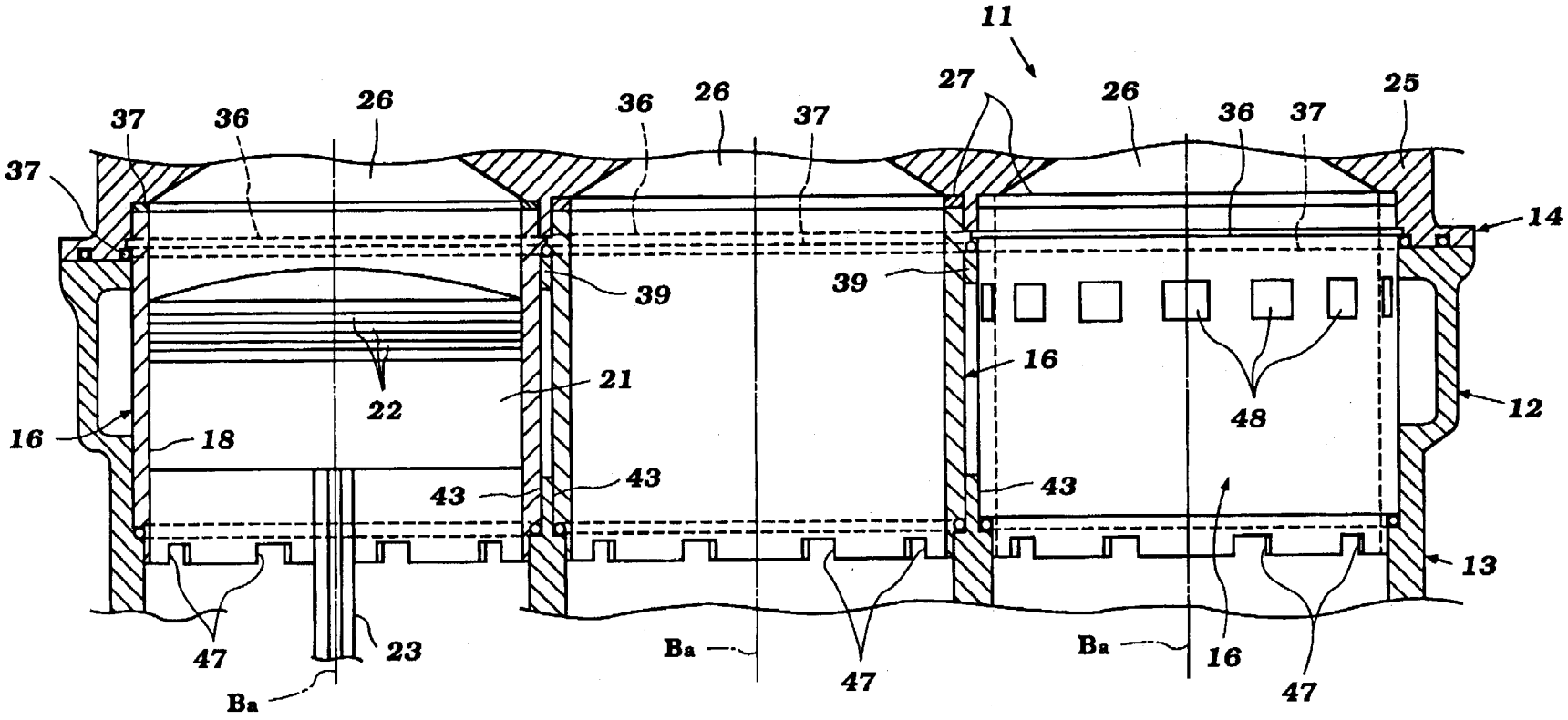
FIG. 2 is an enlarged cross-sectional view taken along the line 2—2 of FIG. 1.

Referring now principally to FIG. 2, each cylinder bore 18 of each cylinder liner 16 slidably supports a piston 21. The piston 21 is also formed from a lightweight material of a suitable type and carries piston rings 22 for sealing engagement with the cylinder liner, cylinder bores 18, in a known manner. Piston pins (not shown) connect the pistons 21 to the upper or small ends of connecting rods 23. The lower ends of the connecting rods 23 are journaled on the throws of a crankshaft 24, in any known manner. Again, since the invention deals primarily with the connection and sealing arrangement between the cylinder liners 16, the cylinder head assemblies 14, and the cylinder block 12, these other components of the engine are not described in any detail.

As seen in FIG. 2, each cylinder liner bore 18 defines a respective axis $B_a$ which axes lie on the aforenoted plane 19. As is typical with V-type engine practice, the bore axes $B_a$ of the one cylinder bank may be staggered relative to those of the adjacent cylinder bank.

The cylinder head assembly 14 is formed from a base material 25 which may be formed from a lightweight alloy, such as aluminum or an aluminum alloy. The cylinder head material 25 is formed with individual recesses 26 which cooperate with the cylinder bores 18 and pistons 21 to form the combustion chambers of the engine.

Figure 3:
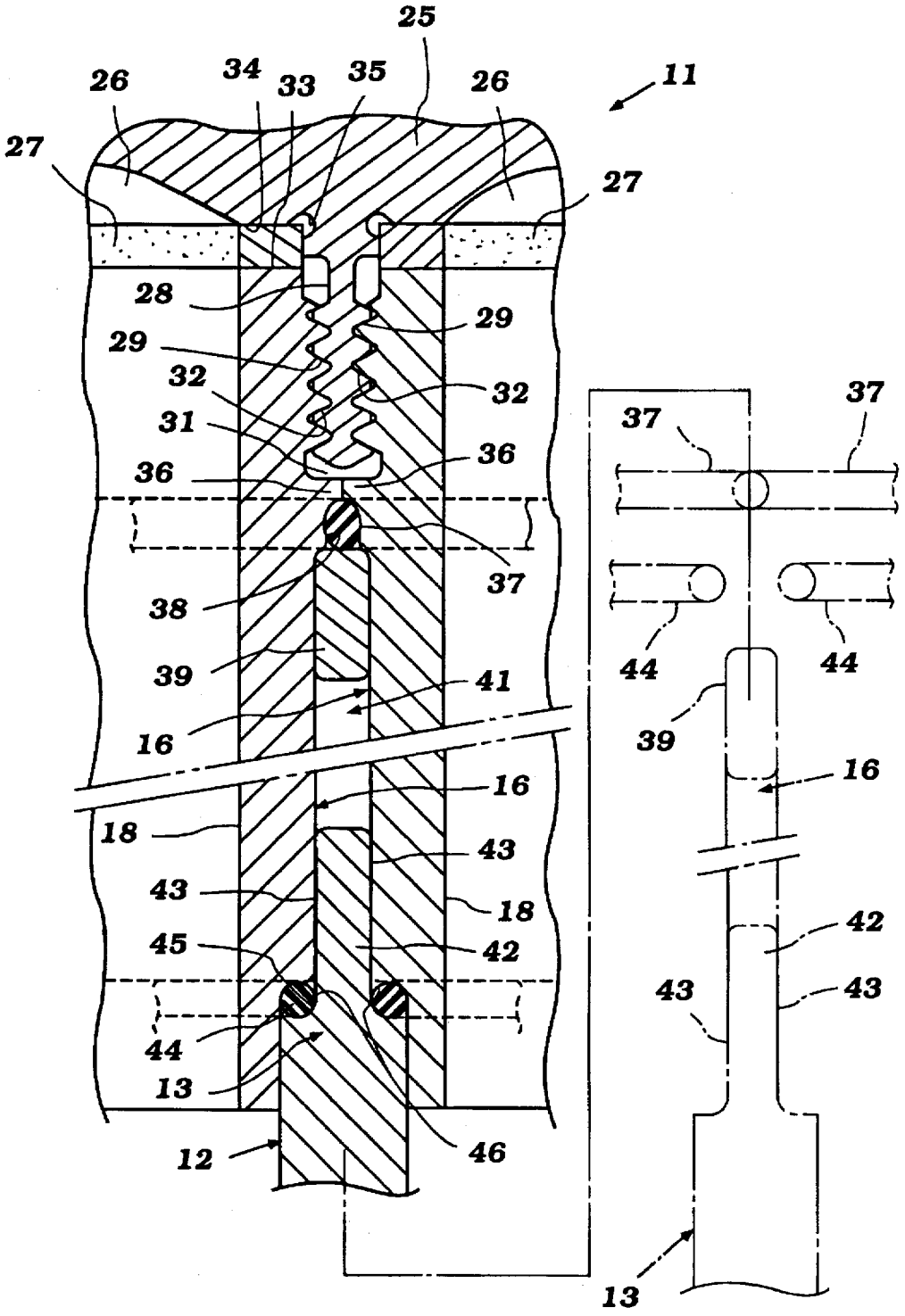
FIG. 3 is a further enlarged cross-sectional view taken along the same plane as FIG. 2, but shows in more detail the construction of the seals around the cylinder liners. In addition, this figure contains a partially exploded view showing how the seals are arranged on the portion of the cylinder block shown in this figure.

A compression seal is formed around the upper ends of the cylinder liners 16 and the base cylinder head material 25 around the combustion chamber recesses 26 by annular sealing rings 27, which may be formed from a metal or a composite material, this seal being shown best in FIG. 3.

It should be noted that the area adjacent each cylinder head recess 26 is formed with a larger diameter portion 28 which lies on an axis coincident with the liner cylinder bore axes $B_a$. At the base of the larger diameter portions 28, there is provided an internal or female thread 29 which terminates at a lower peripheral edge 31. Each cylinder liner 16 is formed with a male threaded end portion 32 having threads complementary to the cylinder head threads 29, and which are threaded thereinto to compress the sealing rings 27 against an end 33 of the cylinder liners 16, and a shoulder 34 formed around the cylinder head recesses 26 inwardly of the larger diameter portions 28. Reliefs 35 are formed between the juncture of the shoulders 34 with the larger diameter portions 28 so as to permit effective sealing without binding. As may be seen in FIG. 3, the configuration is such that a relatively thin portion of the cylinder head material extends between adjacent cylinder bores.

Immediately below their threaded portions 32, the liners 16 have outwardly extending projections 36 which form shoulders that are in abutting relationship at their peripheral edges with those of the adjacent cylinder bank below the end 31 of the male threaded portions 29. A generally O-ring type seal 37 is compressed beneath these projections 36 and engages an upper surface 38 of a portion 39 of the cylinder block material. The area beneath this projection 39 forms a cooling jacket 41 through which liquid coolant is circulated in an appropriate and well-known manner.

Figure 4:
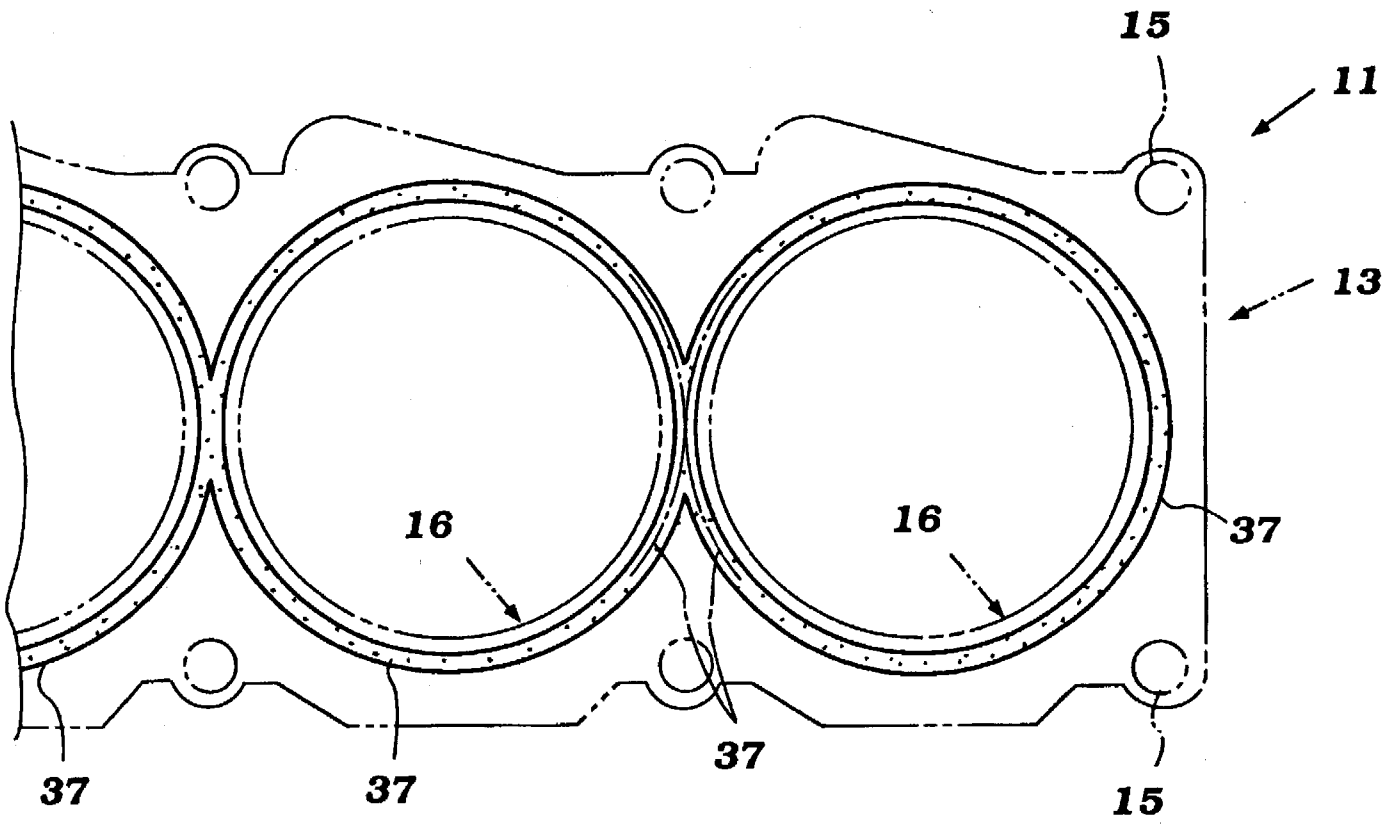
FIG. 4 is a cross-sectional view taken along the line 4—4 of FIG. 1, and shows only the upper seal in solid lines, with the remaining portion of the engine that appears in this figure being illustrated in phantom.

It should be noted from FIG. 4, however, that the sealin 37 is not comprised of individual sealing rings, but rather from O-ring type portions that are integrally joined in the area shown in FIG. 3 between adjacent cylinder liners 16. Hence, the gasket or seal 37 is a single gasket that may be inserted, as shown in FIG. 3, over the cylinder block portions 39 on assembly. This one-piece construction for all of the gaskets 37 will ensure against leakage, and will further ensure that liquid coolant cannot enter the threaded connection between the cylinder head female threads 29 and the liner male threads 31.

The lower portion of the cylinder block 12 is provided with an upstanding projection 42 that defines surfaces 43 which face each of the cylinder liners 16. Individual O-ring seals 44 are loaded between a shoulder 45 formed at the base of the projections 42 and shoulders 46 formed on the lower portions of the cylinder liners 18. As a result of this construction, the water jackets 41 are very effectively sealed and, as noted above, the threaded connections will not encounter any liquid coolant.

In order to facilitate screwing of the liners 16 into the cylinder head material 25, the lower peripheral edges of the liners 16 may be provided with notched edges 47, which can receive an appropriate tool. Alternatively, the outer periphery of the liners 16 may be formed with individual recesses 48, also for receiving a tool so as to permit detachment and attachment.

It has been noted that the cylinder liners 16 are also formed from an aluminum or aluminum alloy. These liners are relatively thin and have a thickness preferably in the range of about 3.5 to 4.5 millimeters for a bore diameter in the range of 85 to 95 millimeters. The bore surfaces 18 are formed with a hardened coating, such as a nickel, or the like. Thus, high strength and light weight is ensured.

Of course, it should be readily apparent to those skilled in the art that the foregoing description is that of a preferred embodiment of the invention. Obviously, various changes and modifications may be made without departing from the spirit and scope of the invention, as defined by the appended claims.

What is claimed is:

1. An internal combustion engine having a cylinder head, a cylinder liner having a threaded connection with said cylinder head and defining a cylinder bore for receiving a piston for driving a crankshaft, a cylinder block having an opening into which said cylinder liner extends and which opening is closed at its upper end by said cylinder head when said cylinder head is affixed thereto, and an annular seal encircling said cylinder liner and engaged with said cylinder block for forming, in part, a seal for a cooling jacket formed between said cylinder block and said cylinder liner, said seal precluding coolant from said cooling jacket from reaching the threaded connection between said cylinder head and said cylinder liner.

2. An internal combustion engine as set forth in claim 1, wherein the cylinder head is formed with a plurality of recesses forming combustion chambers, each surrounded by a threaded portion for receiving a corresponding threaded portion of a respective cylinder liner.

3. An internal combustion engine as set forth in claim 2, wherein the seal between the cylinder block and the cylinder liner comprises an unitary seal surrounding each of the cylinder liners and joined in the area between adjacent cylinder liners.

4. An internal combustion engine as set forth in claim 3, wherein the cylinder head is formed with female threads and the cylinder liners are formed with male threads.

5. An internal combustion engine as set forth in claim 4, wherein the cylinder liner is formed from a lightweight metal having a hardened cylinder bore surface.

6. An internal combustion engine as set forth in claim 5, wherein the cylinder liner is formed from a material selected from a group of aluminum and aluminum alloys.

7. An internal combustion engine as set forth in claim 6, wherein the cylinder liner has a thickness in the range of 3.5 to 4.5 millimeters and a bore diameter in the range of 85 to 95 millimeters.

8. An internal combustion engine as set forth in claim 1, wherein the cylinder liner is formed from a lightweight metal having a hardened cylinder bore surface.

9. An internal combustion engine as set forth in claim 8, wherein the cylinder liner is formed from a material selected from a group of aluminum and aluminum alloys.

10. An internal combustion engine as set forth in claim 9, wherein the cylinder liner has a thickness in the range of 3.5 to 4.5 millimeters and a bore diameter in the range of 85 to 95 millimeters.

11. A cylinder liner for an internal combustion engine, having a cylinder head with a female threaded opening, said cylinder liner having a male threaded portion at one end thereof and being formed from a lightweight alloy having a hardened cylinder bore surface for receiving a piston.

12. An internal combustion engine as set forth in claim 11, wherein the cylinder liner is formed from a material selected from a group of aluminum and aluminum alloys.

13. An internal combustion engine as set forth in claim 12, wherein the cylinder liner has a thickness in the range of 3.5 to 4.5 millimeters and a bore diameter in the range of 85 to 95 millimeters.

14. An internal combustion engine as set forth in claim 11, wherein the cylinder liner is formed from a material selected from a group of aluminum and aluminum alloys.

15. An internal combustion engine as set forth in claim 14, wherein the cylinder liner has a thickness in the range of 3.5 to 4.5 millimeters and a bore diameter in the range of 85 to 95 millimeters.

* * * * *